US007305720B2

(12) United States Patent
Makino et al.

(10) Patent No.: US 7,305,720 B2
(45) Date of Patent: Dec. 11, 2007

(54) TOILET SEAT DEVICE

(75) Inventors: Yoshifumi Makino, Ichinomiya (JP); Hideki Furukawa, Anjo (JP); Sachiyo Nakayama, Hekinan (JP); Masako Tanaka, Handa (JP); Naoko Nawatani, Handa (JP); Kumi Ito, Chita (JP); Noriko Hirasawa, Chita (JP)

(73) Assignees: Aisin Seiki Kabushiki Kaisha, Aichi-ken (JP); INAX Corporation, Aichi (JP)

( * ) Notice: Subject to any disclaimer, the term of this patent is extended or adjusted under 35 U.S.C. 154(b) by 329 days.

(21) Appl. No.: 11/044,215

(22) Filed: Jan. 28, 2005

(65) Prior Publication Data

US 2005/0204460 A1 Sep. 22, 2005

(30) Foreign Application Priority Data

Jan. 29, 2004 (JP) ..... 2004-021897

(51) Int. Cl.
*A47K 13/12* (2006.01)

(52) U.S. Cl. ..... 4/236; 4/240

(58) Field of Classification Search ..... 4/236, 4/420.1–420.5, 443–444, 240
See application file for complete search history.

(56) References Cited

U.S. PATENT DOCUMENTS

2003/0126677 A1* 7/2003 Idota et al. ..... 4/420.4

FOREIGN PATENT DOCUMENTS

JP 9-201312 1/1996

* cited by examiner

*Primary Examiner*—Gregory L. Huson
*Assistant Examiner*—Kristie A. Mahone
(74) *Attorney, Agent, or Firm*—Reed Smith LLP; Stanley P. Fisher, Esq.; Juan Carlos A. Marquez, Esq.

(57) ABSTRACT

A toilet seat device includes a base portion, a toilet seat extending from the base portion in a forward direction, a connecting member fixed at a toilet bowl, at least one hinge member supporting the base portion and the toilet seat, the at least one hinge member lifting up and down the base portion and the toilet seat between the first condition and the second condition, the first condition at which the base portion and the toilet seat are positioned at the toilet bowl substantially in a close contact relation with the toilet bowl, and the second condition at which the base portion and the toilet seat are positioned separately relative to the toilet bowl, and a housing space defined at a bottom surface portion of the base portion and for housing the hinge member therein. The hinge member is housed in the housing space under the first condition.

18 Claims, 5 Drawing Sheets

TOILET SEAT DEVICE

CROSS REFERENCE TO RELATED APPLICATIONS

This application is based on and claims priority under 35 U.S.C. §119 with respect to a Japanese Patent Application 2004-021897, filed on Jan. 29, 2004, the entire content of which is incorporated herein by reference.

FIELD OF THE INVENTION

This invention generally relates to a toilet seat device provided with a warm-water-cleansing device. More particularly, this invention pertains to a toilet seat device being configured to lift up a toilet seat from a toilet bowl and to lift down the toilet seat thereto.

BACKGROUND

In a conventional toilet seat device attached with a private-parts cleansing device for cleansing private parts with cold (room temperature) or hot water, the private-parts cleansing device is mounted and fixed at an upper surface of a toilet bowl by use of mounting bolts, whereupon a private-parts cleansing device was not able to be detached easily from the toilet bowl. Therefore, it was not easy to remove stain between the private-parts cleansing device and the toilet bowl.

In light of the foregoing, recent developments have led to a toilet seat device assembled detachably at a toilet bowl. Moreover, recent developments have led to a toilet seat device connected to a toilet bowl by means of a wire so that the toilet seat device does not drop in the event of being detached from the toilet bowl.

However, in the toilet seat device assembled detachably at the toilet bowl, there is a danger of a toilet seat device, which is being detached for the purpose of cleaning, being on occasions dropped from the toilet bowl, thereby resulting in damage to the toilet seat device itself. In order to prevent the detached toilet seat device from dropping, a space for temporarily placing the detached toilet seat device may be required.

In the toilet seat device having a wire for preventing the toilet seat device from dropping, the toilet seat device being detached is hanged by means of wire. Therefore, there is a possibility of cables and tubes attached to the toilet seat device being on occasions disconnected, thereby creating problems.

In light of the foregoing, a conventional toilet seat device, which is disclosed in JP1997 (09)-201312A is, as is illustrated in FIG. 5, provided with a mounting plate 930 mounted and fixed at a toilet bowl 920, and a sanitary device for washing private parts of a person 910 provided with a toilet seat 911. The sanitary device 910 is engaged at the mounting plate 930. A pair of engagement members 941 is positioned at left-hand and right-hand sides of the toilet bowl 920, while a pair of engagement members 942 is positioned at left-hand and right-hand sides of the toilet bowl 920. One end of each engagement member 941 is rotatably engaged at the sanitary device 910 by means of a pin 943, while the other end thereof is rotatably engaged at the mounting plate 930 by means of a pin 945. One end of each engagement member 942 is rotatably engaged at the sanitary device 910 by means of a pin 944, while the other end thereof is rotatably engaged at the mounting plate 930 by means of a pin 946. Therefore, the sanitary device 910 can be thus lifted up and down above the toilet bowl 920. The sanitary device 910 is switched between a first condition, in which the sanitary device 910 is oriented towards the toilet bowl 920 in a state of close contact, and a second condition, in which a distance has been established between the sanitary device 910 and the toilet bowl 920.

However, experience has taught that a toilet seat device in the first condition, in which the engagement members 941 and 942 are visible from outside, does not look attractive. Moreover, because the engagement members 941 and 942 are visible from the outside, the toilet seat device has on occasions tended to become splashed with dirt. Still moreover, because the engagement members 941 and 942 are easily accessible from the outside, they have on occasions tended to be touched unintentionally.

A need accordingly exists for a toilet seat device with an improved appearance, a toilet seat device in which a lifting mechanism for lifting up and down a toilet seat is not easily recognizable from the outside. Therefore, it is possible to provide a toilet seat device of which a lifting mechanism can be curbed from splashing dirt and is prevented from being touched easily.

SUMMARY OF THE INVENTION

According to an aspect of the present invention, a toilet seat device includes a base portion, a toilet seat extending from the base portion in a forward direction, a connecting member fixed at a toilet bowl, at least one hinge member supporting the base portion and the toilet seat, the at least one hinge member capable of lifting up and down the base portion and the toilet seat between the first condition and the second condition, the first condition at which the base portion and the toilet seat are positioned at the toilet bowl substantially in a close contact relation with the toilet bowl, and the second condition at which the base portion and the toilet seat are positioned with a distance relative to the toilet bowl, and a housing space defined at a bottom surface portion of the base portion and for housing the hinge member therein. The hinge member is housed in the housing space under the first condition.

It is preferable that the at least one hinge member move the base portion and the toilet seat so as to shift the base portion and the toilet seat in the second condition to forward predetermined positions relative to positions of the base portion and the toilet seat in the first condition.

It is further preferable that the at least one hinge member includes at least one first arm of which one end is pivotably supported at a first point on an upper surface of the mounting member and the other end is pivotably supported at a first point at a bottom surface of the housing space.

It is still further preferable that the at least one hinge member further includes at least one second arm of which one end is pivotably supported at a second point on the upper surface of the mounting member and the other end is pivotably supported at a second point at the bottom surface of the housing space. The second point on the upper surface of the mounting member is positioned substantially in front of the first point on the upper surface of the mounting member, and the second point at the bottom surface of the housing space is positioned substantially in front of the first point at the bottom surface of the housing space.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
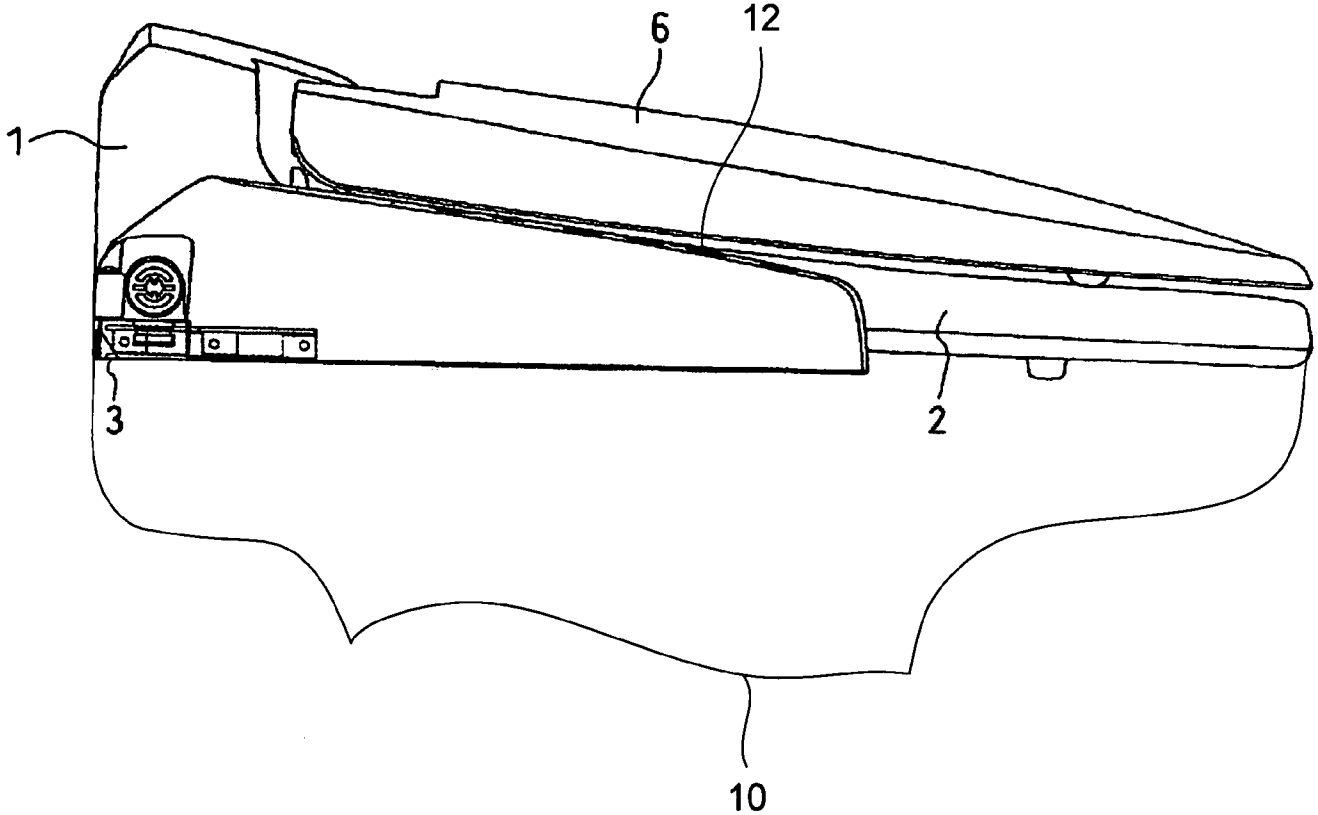
FIG. 1 is a side view schematically illustrating a toilet seat device at a first condition according to an embodiment of the present invention.

An embodiment of the present invention will be described below in detail with reference to the accompanying drawings.

As illustrated in FIGS. 1 to 4, a toilet seat device according to the embodiment of the present invention is provided with a base portion 1, a toilet seat 2, a mounting member 3 and at least one hinge member. The base portion 1 is embedded with an operating panel 12 that shows an instruction for operating devices such as a sanitary device for washing private parts of a person (not shown), a controller (not shown) of a sanitary device, and a sanitary device (not shown). The toilet seat 2 and a toilet lid 6 are pivotably supported at the front of the base portion 1, whereupon the toilet seat 2 and the toilet lid 6 can be pivoted independently relative to the base portion 1. If necessary, the toilet seat 2 can be provided with a heater for heating up the toilet seat 2. The mounting member 3 can be fixed at the toilet bowl 10 by means of a bolt or cramp and so on.

Figure 2:
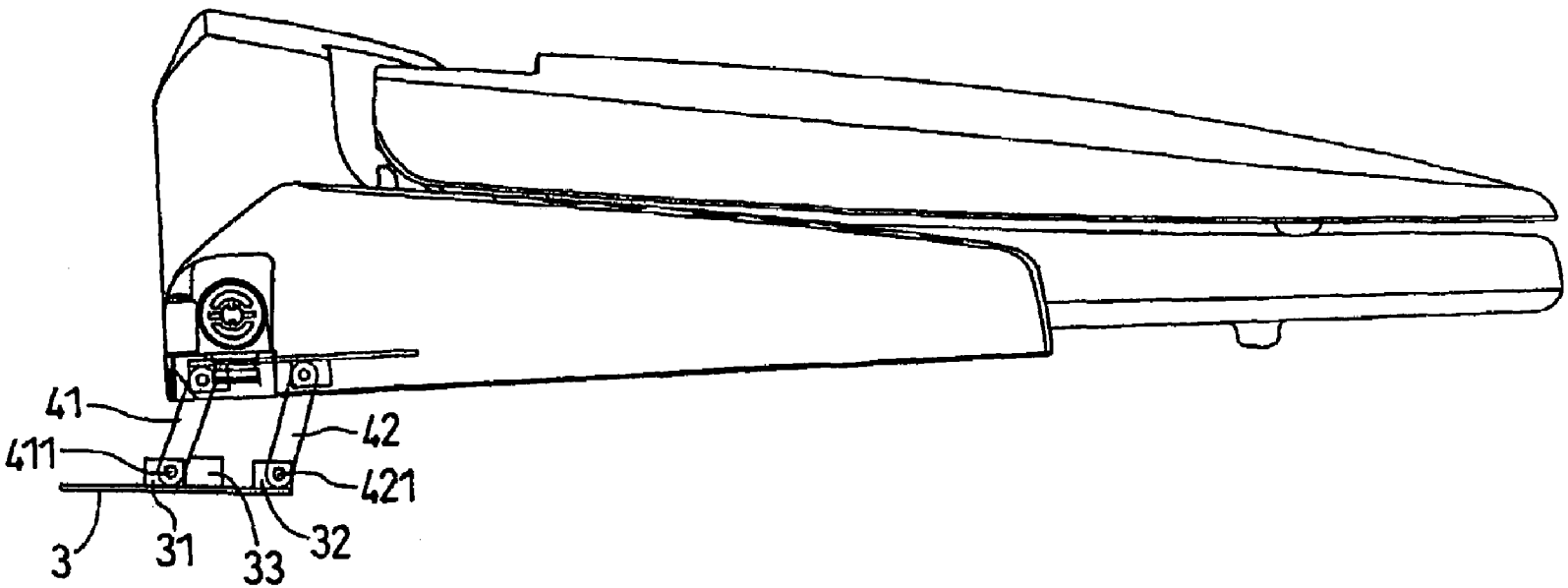
FIG. 2 is a side view schematically illustrating the toilet seat device at a second condition according to the embodiment of the present invention.
Figure 3:
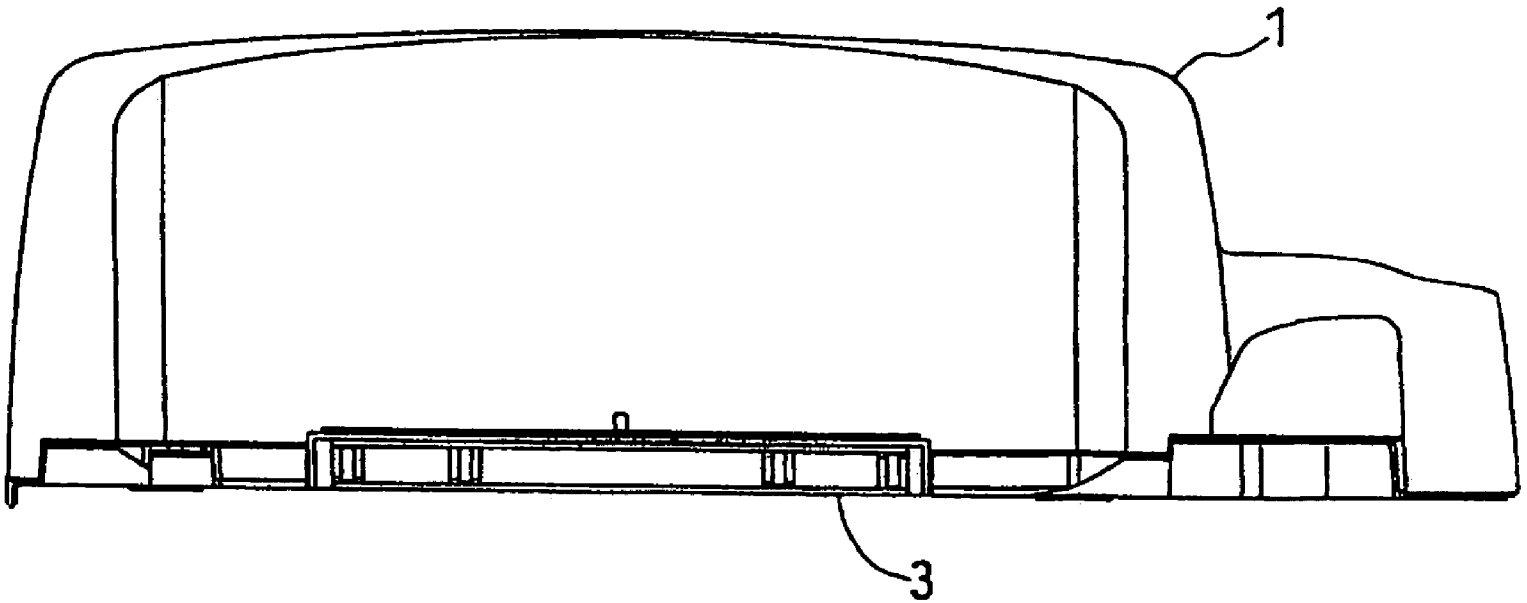
FIG. 3 is a rear view schematically illustrating the toilet seat device at the first condition according to the embodiment of the present invention.

The mounting member 3 is fixed at a rear portion at an upper surface of a toilet bowl 10 by means of bolts (not shown) and nuts (not shown). As illustrated in FIGS. 2 and 3, a lateral directional width of the mounting member 3 is considerably inferior to that of the base portion 1. According to the embodiment of the present invention, as illustrated in FIG. 2, the toilet seat device includes a pair of first arms 41, which are respectively positioned at left-hand and right-hand sides of the toilet bowl 10, and a pair of second arms 42, which are respectively positioned at left-hand and right-hand sides thereof. The first and second arms 41 and 42 structure the hinge member. One end of each of the first arms 41 and one end of each of the second arms 42 are supported respectively and pivotably at the upper surface of the mounting member 3. The pair of first arms 41 is aligned substantially in parallel to each other, while the pair of second arms 42 is aligned substantially in parallel to each other. Alternatively, the toilet seat device can include at least one first arm 41 and at least one second arm 42, a first arm 41 and a second arm 42 which structure the hinge member. One end of the first arm 41 and one end of a second arm 42 are supported respectively and pivotably at an upper surface of the mounting member 3. Moreover, the hinge member can be configured with either the first arm 41 or the second arm 42.

The one end of each first arm 41 is supported pivotably by means of an arm bearing 31 positioned at a first point on the mounting member 3, while the other end of each first arm 41 is supported pivotably by means of an arm bearing 31 positioned at a first point at a bottom surface of the base portion 1, a bottom surface on which the housing space is established. At the same time, the one end of each second arm 42 is supported pivotably by means of an arm bearing 32 positioned at a second point on the mounting member 3, while the other end thereof is supported pivotably by means of an arm bearing 32 positioned at a second point at the bottom surface of the base portion 1.

Figure 4:
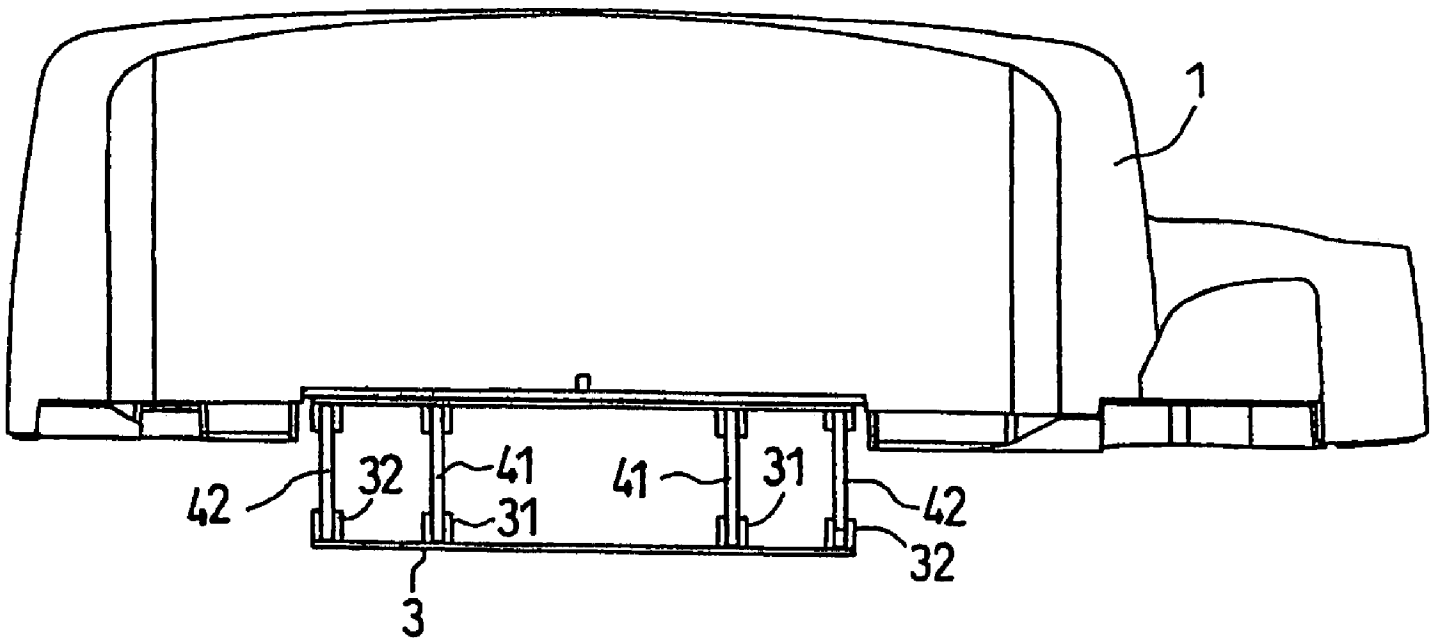
FIG. 4 is a rear view schematically illustrating the toilet seat device at the second condition according to the embodiment of the present invention.
Figure 5:
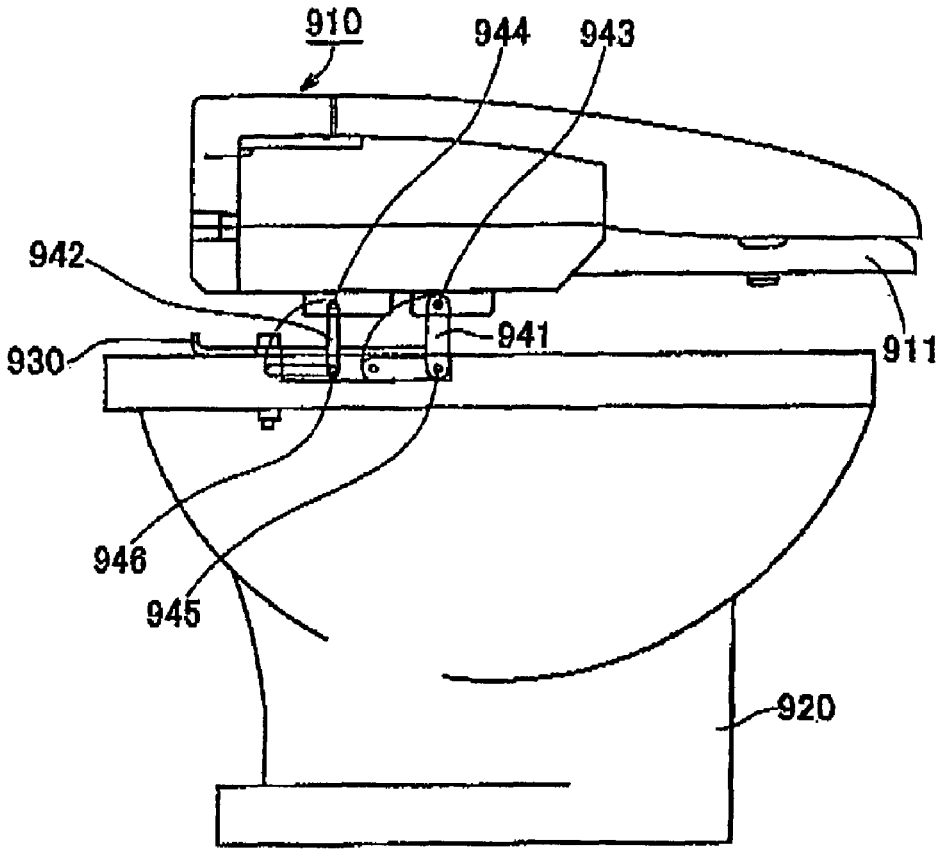
FIG. 5 is a view illustrating a lifting mechanism of a toilet seat device of a conventional work.

As illustrated in FIGS. 3 and 4, for the purpose of avoiding interference between the first and second arms 41 and 42, the second arms 42 are positioned at laterally end portions of the mounting member 3, while the first arms 41 are positioned at laterally inward portions relative to the corresponding second arms 42. When the first and second arms 41 and 42 are oriented substantially in parallel to the mounting member 3, i.e., are in a first condition, the first and second arms 41 and 42 are housed in the housing space established within the base portion 1, and are invisible from the outside. The housing space substantially corresponds to a recessed portion defined in the base portion 1 as illustrated in FIG. 4.

When the toilet seat device includes the hinge member the at least one first arm 41 and the at least one second arm 42, it is preferable that the first and second arms 41 and 42 are substantially in parallel to each other. Invisible from the outside.

The mounting member 3 includes at least one stopper 33 in front of the arm bearing 31 of each of the first arms 41. The stopper 33 of each first arm 41 acts so as to limit a pivotal movement range of each first arm 41. The stopper 33 makes contact with the first arm 41 when the first arm 41 leans from a vertical posture relative to the upper surface of the mounting member 3 toward a front of the toilet seat 2. Therefore, the stopper 33 acts so as to inhibit the first arm 41 from leaning further in a forward direction. In other words, each of the first arms 41 is pivotably moved within a range between the second condition, at which each of the first arms 41 possesses an approximately vertical posture relative to the upper surface of the mounting member 3, and the first condition, at which each of the first arms 41 is substantially in parallel to the upper surface of the mounting member 3 in a condition where the first arm 41 is leaning toward a rear side of the toilet seat 2.

The first arm portion 41 is supported by the stopper 33 with a posture leaning slightly in a forward direction of the toilet seat 2 from the vertical direction. Therefore, a center of gravity of the base portion 1 and the toilet seat 2 is defined in front of a position at which the second arm 42 is pivotably supported. In such a case, it is possible to keep the second condition, by force of an empty weight, at which a gap is established between the upper surface of the toilet bowl 10 and the base portion 1 or the toilet seat 2. The second arm 42 possesses a length that is slightly longer than the first arm 41. As a result, as illustrated in FIG. 2, the front portion of the toilet seat 2 can be lifted up to a considerable degree under the second condition.

According to the embodiment of the present invention, a distance between the first point on the mounting member 3 and the second point on the mounting member 3 is substantially the same as a distance between the first point at the bottom surface of the base portion 1 and the second point at the bottom surface of the base portion 1. Therefore, the first arm 41 and the second arm 42 at the left-hand side are oriented substantially in parallel to each other, while the first arm 41 and the second arm 42 at the right-hand side are oriented substantially in parallel to each other. A link mechanism is thus configured with the first and second arms at the left and right hand sides on the mounting member 3. When the first and second arms 41 and 42 are shifted from the first condition to the second condition, the other ends of the first arms 41 and the other ends of the second arms 42 are pivotably moved so as to lean in a forward direction of the toilet seat 2. Assuming that the toilet seat device includes the at least one first arm 41 and the at least one second arm 42, the link mechanism is configured with the at least one first arm 41 and the at least one second arm 42. In such circumstance, when the first arm 41 and the second arm 42 are shifted from the first condition to the second condition, the other end of the first arm 41 and the other end of the second arm 42 are pivotably moved so as to lean in a forward direction of the toilet seat 2.

At the side of the one ends of the first arms 41 and the second arms 42, the first and second arms 41 and 42 are pivotably moved so as to lean in a rearward direction of the toilet seat 2. At the side of the other ends of the first arms 41 and the second arms 42, the first and second arms 41 and 42 are pivotably moved so as to lean in a frontward direction of the toilet seat 2. Therefore, according to the embodiment of the present invention, the base portion 1 and the toilet seat 2 preferably stand out in a forward direction at a time of shifting from the first condition to the second condition. Especially when the toilet seat device according to the embodiment of the present invention is applied for a toilet bowl having a low tank in close contact with a back side of the base portion 1, the back side of the base portion 1 can be cleaned easily.

Moreover, the base portion 1 is further provided with a lock mechanism (not shown) being detachable from the mounting member 3. The lock mechanism includes a rod member (not shown) movable in an axial direction, an engagement claw (not shown) attached to one end of the rod member and being engageable to and disengageable from a lock groove (not shown) of the mounting member 3 in response to a movement of the rod member, and an operating portion (not shown) attached to the other end of the rod member and exposed at a side surface of the base portion 1. The base portion 1 further includes an engagement member disposed inside the base portion 1 and a biasing spring for biasing the engagement member in a direction of one end portion of the engagement member.

In the event of the first condition, i.e., when the first arms 41 and the second arms 42 is folded, and no gap is established between the toilet bowl 10 and the base portion 1 or the toilet seat 2, the base portion 1 and the mounting member 3 are fixed by the lock mechanism. The hinge member connecting the mounting member 3 with the base portion 1 is housed in the housing space of the base portion 1 and is not exposed outwardly. Therefore, the toilet seat device can assume an improved appearance and the chances are low of its becoming dirt at a time when the toilet seat 2 and the device itself are used. Moreover, because the hinge member is not exposed outwardly, it becomes difficult for the hinge member to be touched unintentionally by a user when the toilet seat 2 and the toilet seat device are used.

When, after the base portion 1 and the toilet seat 2 have been lifted up, a back side of the base portion 1 and the toilet seat 2, or the upper surface of the toilet bowl 10 is cleaned, the base portion 1 and the toilet seat 2 are lifted up in a frontward direction after the lock mechanism has been released. The engagement claw of the lock mechanism is disengaged in response to pulling the operation member, whereupon the base portion 1 and the toilet seat 2 can be freely lifted up and down.

When the base portion 1 and the toilet seat 2 are lifted up, the first arms 41 and the second arms 42 are shifted from the first condition to the second condition. In such an event, the first arms 41 come in contact with the stoppers 33 and retain a leaning angle. As a result, the second arms 42 also stays in response to the movement of the first arm 41. Therefore, the first arm 41 and the second arm 42 remains fixed at the second condition at which the base portion 1 and the toilet seat 2 have been lifted up. The second arms 42 respectively possess the length greater than that of the first arms 41. Therefore, the front portion of the toilet seat 2 can be lifted up to a considerable degree.

In the second condition, at which the base portion 1 and the toilet seat 2 have been lifted up, the back sides of the base portion 1 and the toilet seat 2, or the upper surface of the toilet bowl 10, can be cleansed easily. Moreover, at the second condition, the base portion 1 and the toilet seat 2 are lifted up by the hinge member. Therefore, there is no danger of the base portion 1 and the toilet seat 2 dropping during cleaning. Furthermore, in the second condition, the hinge member is also exposed, and thus the hinge member can be easily cleaned. The size of the mounting member 3, i.e., an area of the mounting member 3 attached to the toilet bowl 10, can be relatively reduced compared with a related work. Therefore, an area of the upper surface of the toilet bowl 10, an area which is covered by the mounting member 3, can be effectively reduced, and the upper surface of the toilet bowl 10 can accordingly be cleaned easily.

As described above, according to the embodiment of the present invention, the first arm 41 is positioned laterally inside of the second arm 42. Moreover, it is preferable that the second arm 42 be positioned ahead of the first arm 41 in terms of the one and the other ends of the second arm 42.

Further, it is preferable that the hinge member be provided with a speed moderating mechanism for moderating an operation speed from the second condition to the first condition. Still further, it is preferable that the hinge member be provided with a damping mechanism for slowly curbing a descent of the base portion 1 and the toilet seat 2. In such a case, even when, for purposes of cleaning, the base portion 1 or the toilet seat 2 lifts down unexpectedly, any damage to the toilet seat device can be prevented. The toilet seat device with the aforementioned structure can be prevented from being damaged even when the toilet seat 2 or the base portion 1 is used for an ordinal usage. The descending speed moderating mechanism can possess a non-limiting structure, and can be achieved by a device utilizing a fluid resistance passing through an orifice or a mechanical mechanism. The damping mechanism can also possess a non-limiting structure, and can be achieved by a flexible member such as a spring.

According to the embodiment of the present invention, as far as the base portion 1 can support the toilet seat 2 for its pivotal movement, a device such as a hot-water storage tank, a cleaning nozzle, a heating apparatus, an air fresher can be mounted on the base portion 1. Although a device, which is mounted in the base portion 1, may require an electrical connection with the outside, or connection with a pipe laid for a rinse water. According to the embodiment of the present invention, the base portion 1 can be lifted up and down in an orderly fashion by means of the hinge member. Therefore, problems associated with dealing with wiring in the event that the base portion 1 is detached are so minor as to be insignificant.

The mounting member 3 is mounted and fixed on the toilet bowl 10 by several mounting methods such as bolts and clamps. The mounting member 3 can have an area sufficient for attaching the hinge member thereon. However, according to the embodiment of the present invention, the hinge member possesses an area sufficient to be housed in the housing space. Therefore, unlike in related art, the mounting member 3 does not need to possess a size substantially the same as the toilet bowl 10, or larger. For example, the mounting member 3 can posses a size substantially the same as an entire area of the housing space, or even smaller. More specifically, the mounting member 3 can possess at a minimum a lateral length of 200 mm and a longitudinal length of 100 mm.

According to the embodiment of the present invention, the hinge member includes the first and second arms 41 and 42. Alternatively, the hinge member can include at least one of the first and second arms 41 and 42. One end of the arm is pivotably supported at one surface side of the mounting member 3, while the other end of the arm is pivotably supported in the housing space. It is sufficient for the housing space of the base portion 1 to possess a size in which the arms can be housed therein. For example, the housing space of the base portion 1 can possess a size sufficient for housing the entire hinge member. Further, the housing space of the base portion 1 can possess plural spaces having the minimum area necessary for the respective arms.

The hinge member pivotally moves from the first condition, in which the hinge member is oriented substantially horizontal relative to the mounting member and the upper surface of the toilet bowl 10, to the second condition, in which the hinge member passes a vertical direction slightly. It is preferable that the hinge member is restrained from further pivotal movement from the second condition. For example, a range of the pivotal movement of the hinge member can be limited by mounting a limiting member for limiting the pivotal movement of the hinge member. Especially, the base portion 1 and the toilet seat 2 can be moved forward, in the second condition, by pivotally moving the hinge member in a rearward direction of the toilet seat from the vertical direction at the side of the mounting member and by pivotally moving the hinge member in a forward direction of the toilet seat from the vertical direction at the side of the housing space.

It is also preferable that the hinge arm include the first arm 41 and the second arm 42 aligned in a longitudinal direction. Moreover, it is further preferable that the hinge arm include more than one set of the first arm 41 and the second arm 42, more than one set thereof which is aligned in a lateral direction. In such a case, the base portion 1 and the toilet seat 2 can be supported reliably. The number of sets of the first arm 41 and the second arm 42 can be determined depending on a strength required to the device. That is, when the device is required to possess much larger strength, the requirement can be satisfied by increasing the number of sets of the first arm 41 and the second arm 42.

For example, when two arms (first and second arms) are aligned back and forth, it is preferable that the first arm be pivotably supported at rear portions of the mounting member and the housing space, and that the second arm be pivotally supported in front of the first arm. In such a case, when the length of the second arm is greater than that of the first arm, the front portion of the toilet seat 2 can be lifted up to a considerable degree. The degree to which the front portion of the toilet seat 2 is lifted up, i.e., a difference between the length of the first arm and the length of the second arm depends on the degree of a gap necessary at a rear surface of the base portion 1. In other words, when the front portion of the toilet seat 2 is lifted up excessively, the bottom surface of the toilet seat 2 can be cleaned easily. But on the other hand, the rear surface of the base portion 1 approaches the low tank in a rearward direction, and so the rear surface of the base portion 1 can not be cleaned easily.

The principles, the preferred embodiments and mode of operation of the present invention have been described in the foregoing specification. However, the invention which is intended to be protected is not to be construed as limited to the particular embodiment disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A toilet seat device comprising:

a base portion placed above a toilet bowl;

a toilet seat extending from the base portion in a forward direction;

a mounting member fixed at the toilet bowl and having a lateral length smaller than a lateral length of the toilet bowl;

at least one hinge member supporting the base portion and the toilet seat, the at least one hinge member capable of lifting up and down the base portion and the toilet seat between a first condition and a second condition, the first condition in which the base portion and the toilet seat are positioned at the toilet bowl substantially in a state of close contact with the toilet bowl, and the second condition in which the base portion and the toilet seat are positioned at predetermined distances relative to the toilet bowl; and a housing space established at a bottom surface portion of the base portion and recessed inside the base portion, the housing space being adapted to house the at least one hinge member therein to be invisible from outside, wherein, in the first condition, the hinge member is housed in the housing space.

2. The toilet seat device according to claim 1, wherein the at least one hinge member moves the base portion and the toilet seat so as to shift the base portion and the toilet seat in the second condition to forward predetermined positions relative to positions of the base portion and the toilet seat in the first condition.

3. The toilet seat device according to claim 2, wherein the at least one hinge member includes at least one first arm of which one end is pivotably supported at a first point on an upper surface of the mounting member and an other end is pivotably supported at a first point at a bottom surface of the housing space.

4. The toilet seat device according to claim 3, wherein the at least one hinge member includes at least one second arm of which one end is pivotably supported at a second point on the upper surface of the mounting member and an other end is pivotably supported at a second point at the bottom surface of the housing space, wherein the second point on the upper surface of the mounting member is positioned substantially in front of the first point on the upper surface of the mounting member, and the second point at the bottom surface of the housing space is positioned substantially in front of the first point at the bottom surface of the housing space.

5. The toilet seat device according to claim 4, wherein a length of the second arm is designed to be greater than a length of the at least one first arm.

6. The toilet seat device according to claim 4, wherein the at least one hinge member is two hinge members and each of the two hinge members includes both the at least one first arm and the at least one second arm, and wherein both the at least one first arm and the at least one second arm of one of the two hinge members are positioned at one side of the toilet seat and both at least one first arm and the at least one second arm of an other one of the two hinge members are positioned at an other side of the toilet seat, the one side of the toilet seat is opposed to the other side of the toilet seat in a lateral direction.

7. The toilet seat device according to claim 2 further comprising:

a stopper for restraining a degree of a pivotal movement of the hinge member, wherein the forward predetermined positions are determined by the stopper.

8. The toilet seat device according to claim 3, further comprising:

a stopper for restraining a degree of a pivotal movement of the at least one first arm centered on the first point on the upper surface of the mounting member.

9. The toilet seat device according to claim 4, further comprising:

a stopper for restraining a degree of a pivotal movement of the at least one first arm centered on the first point on the upper surface of the mounting member.

10. The toilet seat device according to claim 1, wherein the toilet seat is pivotably attached at the base portion.

11. A toilet seat device comprising:

a base portion placed above the toilet bowl;

a toilet seat extending from the base portion in a forward direction;

a mounting member fixed at the toilet bowl and having a lateral length smaller than a lateral length of the toilet bowl;

a housing space established at a bottom surface portion of the base portion and recessed inside the base portion, the housing space being adapted to house the at least one hinge member therein to be invisible from outside; and at least one link mechanism disposed between a portion of the housing space and the mounting member, the at least one link mechanism defining a first condition, in which the at least one link mechanism is positioned in a closed space established between the housing space and the mounting member while in a stationary condition, and the base portion and the toilet seat are positioned at the toilet bowl in a state of close contact with the toilet bowl; and a second condition, in which the at least one link mechanism substantially stands up, and the base portion and the toilet seat are lifted up from the toilet bowl.

12. The toilet seat device according to claim 11, wherein the link mechanism moves the base portion and the toilet seat so as to shift the base portion and the toilet seat in the second condition to forward predetermined positions relative to positions of the base portion and the toilet seat in the first condition.

13. The toilet seat device according to claim 12, wherein the link mechanism includes a first arm positioned rearward and a second arm positioned frontward, one end of the first arm is pivotably supported at a first point on an upper surface of the mounting member and an other end thereof is pivotably supported at a first point at a bottom surface of the base portion, and one end of the second arm is pivotably supported at a second point on the upper surface of the mounting member and an other end thereof is pivotably supported at a second point at the bottom surface of the base portion.

14. The toilet seat device according to claim 13, wherein a length of the at least one second arm is designed to be greater than a length of the at least one first arm.

15. The toilet seat device according to claim 13, wherein the predetermined positions are determined by a stopper restraining a degree of a pivotal movement of the first arm.

16. The toilet seat device according to claim 11, wherein the toilet seat is pivotably attached at the base portion.

17. The toilet seat device according to claim 11, wherein the toilet seat is integrated with the base portion.

18. The toilet seat device according to claim 11, wherein the base portion is pivotably attached with a toilet lid covering the toilet seat.

* * * * *